US010975736B2

(12) United States Patent
Kim

(10) Patent No.: US 10,975,736 B2
(45) Date of Patent: Apr. 13, 2021

(54) ADAPTER FOR ROLLER TAPPET OF ENGINE AND ENGINE ROLLER TAPPET ASSEMBLY INCLUDING SAME

(71) Applicant: DOOSAN INFRACORE CO., LTD., Incheon (KR)

(72) Inventor: Jong-young Kim, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 16/479,354

(22) PCT Filed: Jan. 19, 2018

(86) PCT No.: PCT/KR2018/000881
§ 371 (c)(1),
(2) Date: Jul. 19, 2019

(87) PCT Pub. No.: WO2018/135893
PCT Pub. Date: Jul. 26, 2018

(65) Prior Publication Data

US 2019/0353057 A1 Nov. 21, 2019

(30) Foreign Application Priority Data

Jan. 20, 2017 (KR) ..... 10-2017-0009640

(51) Int. Cl.
*F01L 1/14* (2006.01)
*F01M 1/08* (2006.01)
(Continued)

(52) U.S. Cl.
CPC ..... *F01L 1/146* (2013.01); *F01M 1/08* (2013.01); *F01M 9/104* (2013.01); *F01P 3/08* (2013.01);
(Continued)

(58) Field of Classification Search
CPC ..... F01L 1/146; F01L 2105/02; F01M 1/08; F01M 9/104; F01P 3/08
See application file for complete search history.

(56) References Cited

U.S. PATENT DOCUMENTS

2016/0319708 A1 11/2016 Nielsen

FOREIGN PATENT DOCUMENTS

EP 1319810 A1 * 6/2003 ..... F01M 11/02
EP 1319810 B1 1/2007
(Continued)

OTHER PUBLICATIONS

International Search Report dated Apr. 25, 2018, corresponding to International Application No. PCT/KR2018/000881 citing the above reference(s).

*Primary Examiner* — Kevin A Lathers
(74) *Attorney, Agent, or Firm* — Hauptman Ham, LLP

(57) ABSTRACT

An adapter for a roller tappet of an engine may include a body and a support. The body may be combined with a cylinder block of the engine. The body may include oil inlet connected to main gallery of the cylinder block to receive an oil from the main gallery. The support may be extended from one end of the body to support the roller tappet. The support may include a first oil passageway connected to the oil inlet. The first oil passageway is formed through the body and the support to supply the oil supplied from the oil inlet to the roller tappet. Thus, the oil may be supplied from the main gallery to the roller tappet through the oil passageway so that it may not be required to form an additional oil passageway, which may supply the oil to the roller tappet, in the cylinder block.

8 Claims, 4 Drawing Sheets

(51) Int. Cl.
*F01M 9/10* (2006.01)
*F01P 3/08* (2006.01)

(52) U.S. Cl.
CPC ..... *F01L 2305/02* (2020.05); *F01L 2307/00* (2020.05); *F01M 2001/083* (2013.01)

(56) References Cited

FOREIGN PATENT DOCUMENTS

| | | | |
|---|---|---|---|
| JP | 2004-190634 | A | 7/2004 |
| JP | 2005-90246 | A | 4/2005 |
| KR | 10-0376676 | B1 | 3/2003 |

* cited by examiner

ADAPTER FOR ROLLER TAPPET OF ENGINE AND ENGINE ROLLER TAPPET ASSEMBLY INCLUDING SAME

CROSS-REFERENCE TO RELATED APPLICATION

The present application is a national stage filing under 35 U.S.C § 371 of PCT application number PCT/KR2018/000881 filed on Jan. 19, 2018 which is based upon and claims the benefit of priority to Korean Patent Application No. 10-2017-0009640, filed on Jan. 20, 2017, in the Korean Intellectual Property Office, which is incorporated herein in its entirety by reference.

BACKGROUND

1. Field

Example embodiments relate to an adapter for a roller tappet of an engine and a roller tappet assembly of an engine including the same. More particularly, example embodiments relate to an adapter for preventing a rotation of a roller tappet, which may convert a rotary force of a cam into a linear force and then transmit the linear force to intake/exhaust valves, and a roller tappet assembly of an engine including the adapter.

2. Description of the Related Art

Generally, a driving force generated in a combustion chamber of an engine may be transferred to a camshaft. A rotary force of a cam of the camshaft may be converted into a linear force by a tappet assembly. The tappet assembly may be classified into a tappet having a flat surface configured to make contact with the cam, and a roller tappet including a one-way rotatable roller configured to make contact with the cam. The linear force generated by interacting between the tappet and the cam may be transferred to a valve opening/closing mechanism.

In the roller tappet, a damage caused by a friction between the tappet and the cam may be reduced by rotating the roller. However, when a rotation direction of the roller may be changed due to a rotation of the roller tappet, a transfer ratio of the rotary force of the cam to the intake/exhaust valves may be greatly decreased. Thus, an apparatus for preventing the rotation of the roller tappet may be provided to the roller tappet.

According to related arts, the roller tappet may be fixed to a cylinder block of the engine using a pin or a key. In using the pin, it may be difficult to assembly the pin with the roller tappet arranged at a deep position in the cylinder block. In using the key, it may difficult to form a key groove at the cylinder block into which the key may be inserted. Further, in using the pin or the key, it may be required to additionally form an oil gallery for lubricating the roller tappet in the cylinder block.

SUMMARY

Example embodiments provide an adapter for a roller tappet of an engine that may be capable of preventing the rotation of the roller tappet and easily lubricating the roller tappet of the engine.

Example embodiments also provide a roller tappet assembly including the above-mentioned adapter.

According to example embodiments, there may be provided an adapter for a roller tappet of an engine. The adapter may include a body and a support. The body may be combined with a cylinder block of the engine. The body may include oil inlet connected to main gallery of the cylinder block to receive an oil from the main gallery. The support may be extended from one end of the body to support the roller tappet. The support may include a first oil passageway connected to the oil inlet. The first oil passageway is formed through the body and the support to supply the oil supplied from the oil inlet to the roller tappet.

In example embodiments, the body may include a threaded portion threadedly combined with the cylinder block.

In example embodiments, the body may further include a bolt portion for threadedly combining the threaded portion with the cylinder block.

In example embodiments, the support may further include a second oil passageway extended from the oil inlet toward the other end of the body. The second oil passageway may be connected to a piston cooling jet.

According to example embodiments, there may be provided a roller tappet assembly of an engine. The roller tappet assembly may include a roller housing, a tappet roller and an adapter. The roller housing may support a tappet rod vertically movably arranged in a cylinder block of the engine. The tappet roller is rotatably arranged at one side of the roller housing. The tappet roller may rotatably make contact with a cam to allow a linear reciprocating motion of the tappet rod. The adapter may be combined with the cylinder block to support the roller housing. The adapter may include an oil passageway for providing an oil in a main gallery of the cylinder block to the roller housing.

In example embodiments, the roller housing may include a rotation-preventing groove for receiving the adapter.

In example embodiments, the adapter may include a threaded portion. The cylinder block may include a threaded portion threadedly combined with the threaded portion of the adapter.

In example embodiments, the oil passageway may be connected to a piston cooling jet.

In example embodiments, the cylinder block may include a fixing hole formed through the cylinder block. The adapter may be inserted into the fixing hole. The fixing hole may have a threaded portion formed on an inner surface of the fixing hole. The threaded portion of the fixing hole may be threadedly combined with a threaded portion formed on an outer surface of the adapter.

In example embodiments, the rotation-preventing groove may be formed through the roller housing to be connected an inner region of the roller housing. The adapter may include a first oil passageway connected to the main gallery when mounting the adapter. The oil supplied from the main gallery when mounting the adapter may be supplied into the roller housing through the first oil passageway and the rotation-preventing groove.

According to example embodiments, the adapter for supporting the roller tappet may include the oil passageway connected to the main gallery of the cylinder block. Thus, the oil may be supplied from the main gallery to the roller tappet through the oil passageway. As a result, it may not be required to form an additional oil passageway, which may supply the oil to the roller tappet, in the cylinder block. Further, because the piston cooling jet may be assembled with the adapter, a structure of the cylinder block for assembling the piston cooling jet may be reduced. As a result, the adapter may have the function for preventing the rotation of the roller tappet and the function for supplying the oil so that machining the cylinder block may be reduced.

BRIEF DESCRIPTION OF THE DRAWINGS

Example embodiments will be more clearly understood from the following detailed description taken in conjunction with the accompanying drawings.

FIG. 1 is an exploded perspective view illustrating a pair of roller tappet assemblies mounted at a cylinder block of an engine in accordance with example embodiments;

FIG. 2 is a cross-sectional view illustrating a roller tappet and an adapter of the roller tappet assembly in FIG. 1;

FIG. 3 is a front view illustrating the adapter in FIG. 2;

FIG. 4 is a cross-sectional view taken along a line IV-IV' in FIG. 3; and FIG. 5 is a cross-sectional view taken along a line V-V' in FIG. 3.

DETAILED DESCRIPTION OF THE EMBODIMENTS

Figure 1:
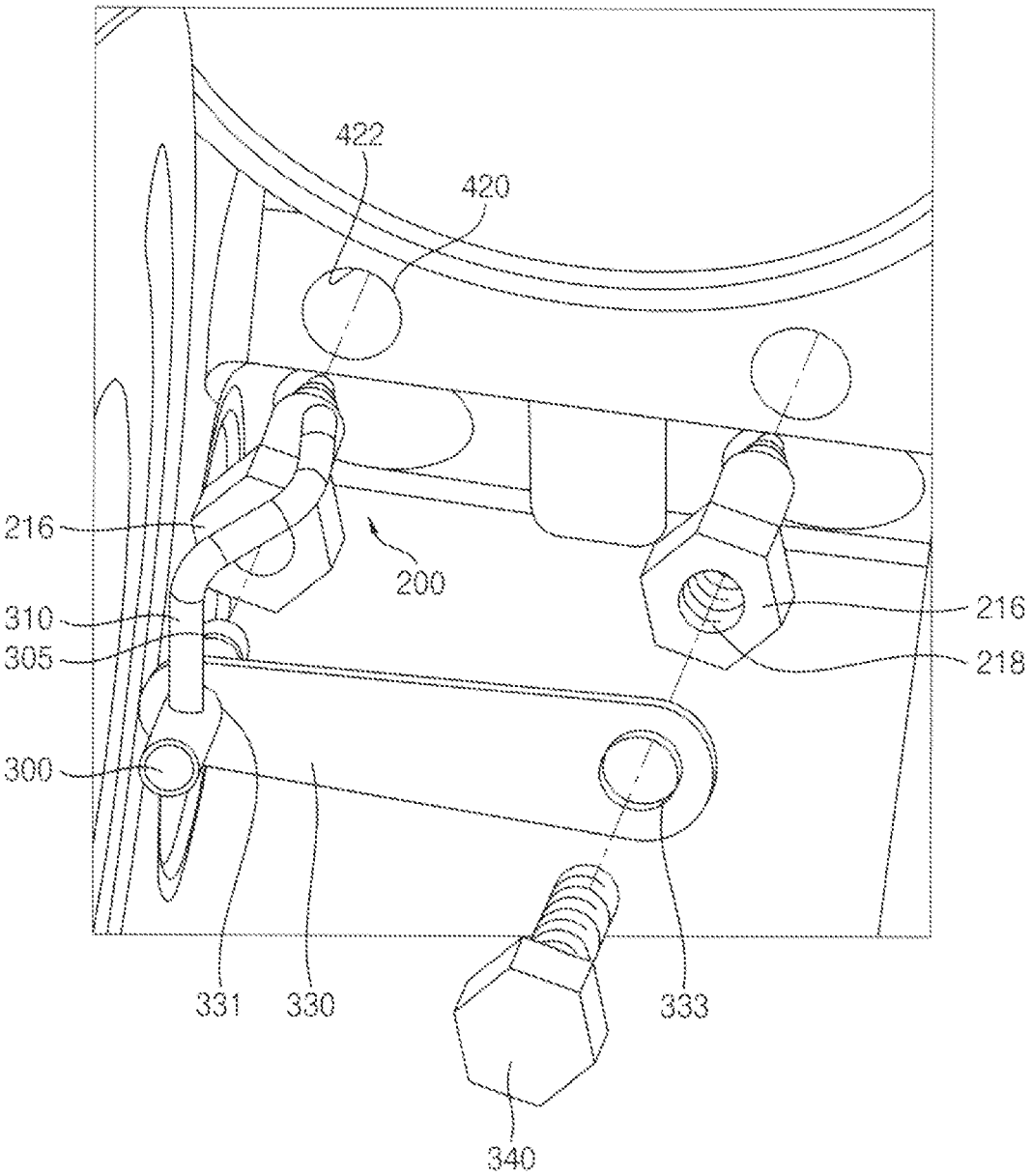
FIGS. 1 to 5 represent non-limiting, example embodiments as described herein.

Various example embodiments will be described more fully hereinafter with reference to the accompanying drawings, in which some example embodiments are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained in detail with reference to the accompanying drawings.

Figure 2:
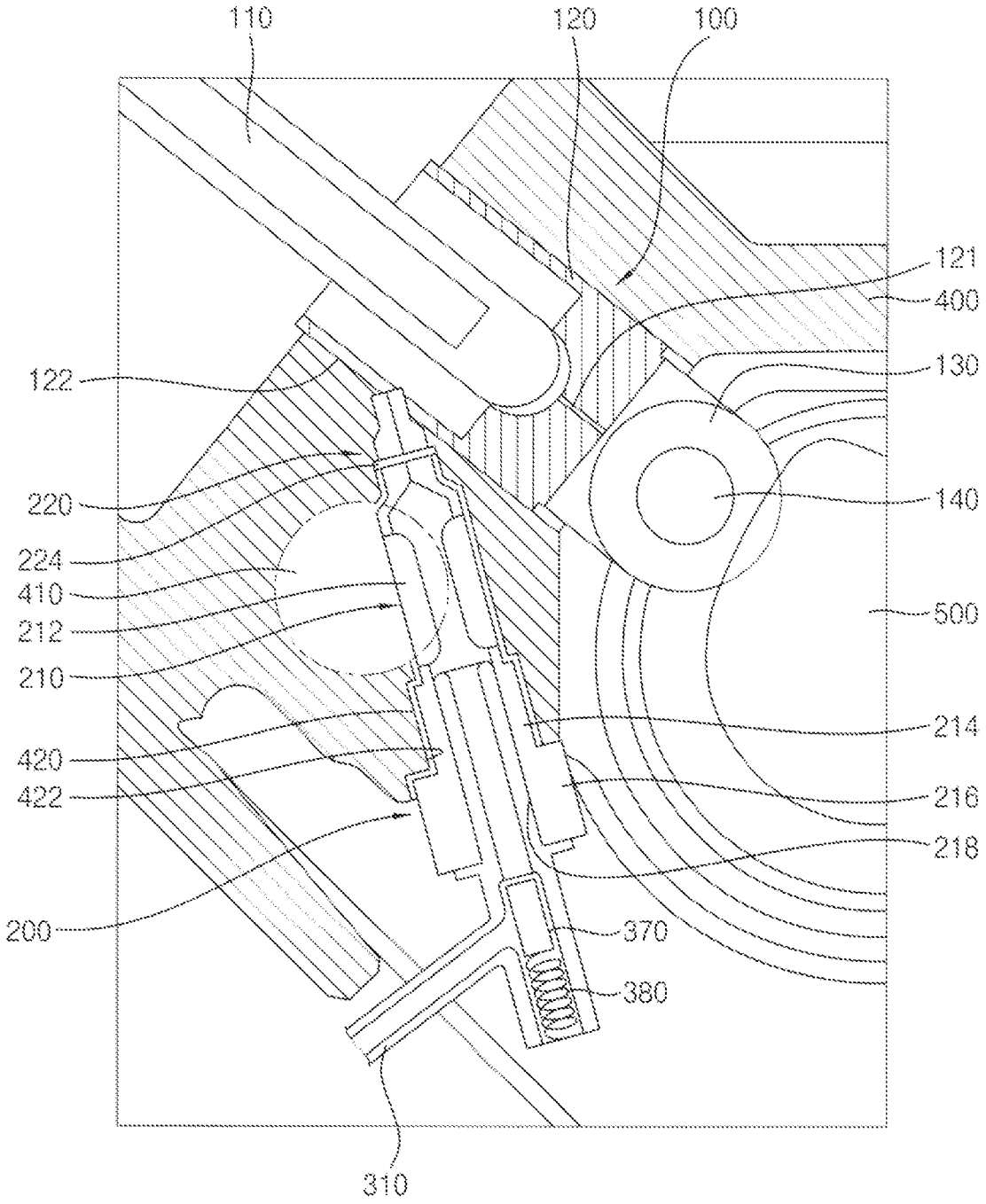

FIG. 1 is an exploded perspective view illustrating a pair of roller tappet assemblies mounted at a cylinder block of an engine in accordance with example embodiments, and FIG. 2 is a cross-sectional view illustrating a roller tappet and an adapter of the roller tappet assembly in FIG. 1.

Referring to FIGS. 1 and 2, a roller tappet assembly of this example embodiment may include a roller tappet 100 and an adapter 200.

The roller tappet 100 may be arranged between a cam 500 of a camshaft and a push rod. The cam 500 may be rotated by a force generated in a combustion chamber of an engine. The roller tappet 100 may convert the rotary force of the cam 500 into a linear force. The roller tappet 100 may then transfer the linear force to the push rod. Thus, the roller tappet 100 may include a lower end configured to make contact with the cam 500, and an upper end connected to the push rod. The roller tappet 100 may be vertically moved by the rotation of the cam 500 to convert the rotary force of the cam 500 into the linear force transferred to the push rod. Further, the roller tappet 100 may be movably arranged in a cylinder block 400. The cylinder block 400 may have a main gallery 410 through which an oil may flow.

The roller tappet 100 may include a pair of the roller tappets 100 provided to one combustion chamber. Each of the roller tappets 100 may include a roller housing 120 and a tappet roller 130. The roller housing 120 may be configured to support a tappet rod 110.

The tappet rod 110 may be movably arranged in the cylinder block 400. The tappet rod 110 may have a cylindrical shape. Thus, the tappet rod 110 may have an axial direction corresponding to a moving direction of the tappet rod 110. An upper end of the tappet rod 110 may be connected with the push rod. The tappet rod 110 may include a pair of the tappet rods 110 provided to one combustion chamber. Therefore, the roller tappet 100 and the adapter 200 also may include a pair of the roller tappets 100 and a pair of the adapters 200 provided to one combustion chamber.

The roller housing 120 may be arranged at a lower end of the tappet rod 110. The roller housing 120 may be integrally formed with the lower end of the tappet rod 110. Alternatively, the roller housing 120 may be a separated element combined with the lower end of the tappet rod 110.

The tappet roller 130 may be rotatably arranged in the roller housing 120. The tappet roller 130 may be rotatably connected with the roller housing 120 by a rotation shaft 140. The rotation shaft 140 may be installed at the roller housing 120. Thus, the tappet roller 130 may be rotated with respect to the rotation shaft 140. The tappet roller 130 may rotatably make contact with the cam 500. The tappet roller 130 may have a cylindrical shape extended in an axial direction of the rotation shaft 140.

The adapter 200 may be configured to movably support one end of the roller tappet 100 in one direction to prevent the roller housing 120 from being rotated. That is, the tappet roller 130 may prevent a rotating direction of the tappet roller 130 from being changed. An end of the adapter 200 may function as a support 220. An end of the support 220 may be partially inserted into a rotation-preventing groove 122. The rotation-preventing groove 122 may have a long hole formed at one end of the roller housing 120. The end of the adapter 200 may prevent the roller housing 120, which may be co-operated with the cam 500, from being rotated.

Figure 3:
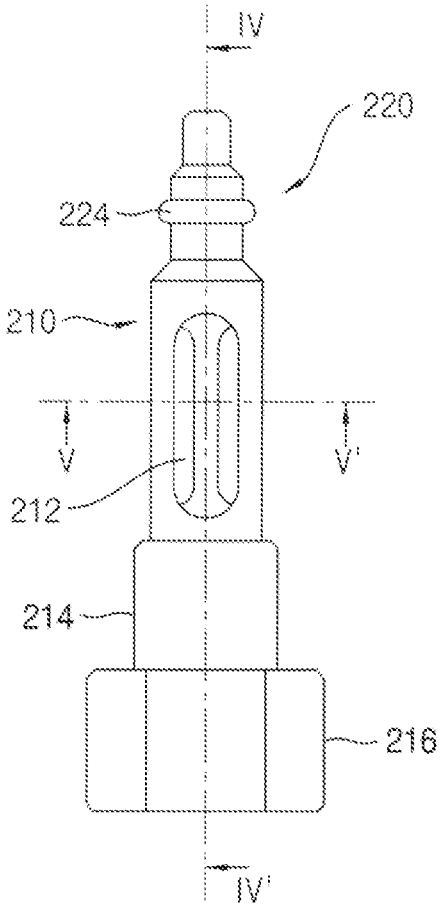
Figure 4:
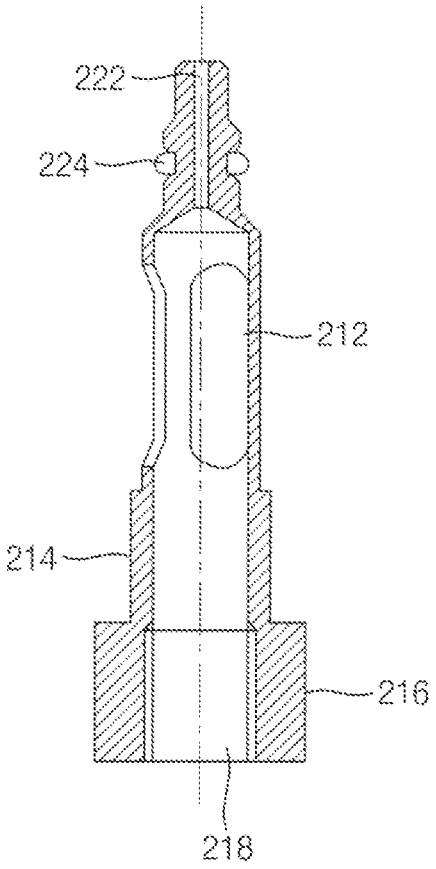
Figure 5:
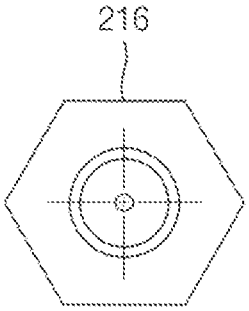

FIG. 3 is a front view illustrating the adapter in FIG. 2, FIG. 4 is a cross-sectional view taken along a line IV-IV' in FIG. 3, and FIG. 5 is a cross-sectional view taken along a line V-V' in FIG. 3.

Referring to FIGS. 3 to 5, each of the pair of the adapters 200 may include a body 210 and the support 220.

The body 210 may be inserted into a fixing hole 420 formed at the cylinder block 400. The body 210 may be arranged adjacent to the roller tappet 100. The fixing hole 420 may include a groove shape formed at the cylinder block 400 adjacent to the roller tappet 100. Alternatively, the fixing hole 420 may be formed through the cylinder block 400. The fixing hole 420 may have gradually decreased diameters toward the roller tappet 100. Thus, the adapter 200 may be easily combined with the cylinder block 200 by simply inserting the body 210 into the fixing hole 420. Therefore, the adapter 200 and the roller tappet 100 may be readily assembled and machining the cylinder block 400 may be decreased. The body 210 may be positioned adjacent to the main gallery 410 of the cylinder block 400. The body 210 may be arranged slant to the axial direction of the tappet rod 110. Thus, the body 110 may include one end oriented toward the roller housing 120, and the other end opposite to the roller housing 120.

The body 210 may include an oil inlet 212 connected to the main gallery 410. Thus, the oil in the main gallery 210 may be supplied to the oil inlet 212 of the body 210. The oil inlet 212 may include a plurality of holes formed at an upper portion of the body 210 in the axial direction of the body 210. When the body 210 may be installed at the cylinder block 400, the oil inlet 212 may face the main gallery 410 to receive the oil injected from the main gallery 410.

The body 210 may include a threaded portion 214. The threaded portion 214 may be formed on an outer circumferential surface of the body 210. Particularly, the threaded portion 214 may be positioned under the oil inlet 212. The threaded portion 214 may be threadedly combined with a threaded portion 422 of the fixing hole 420 formed at the cylinder block 400. Thus, the adapter 200 may be combined with the fixing hole 420 by threadedly combining the threaded portion 214 of the adapter 200 with the threaded portion 422 of the fixing hole 420.

The body 210 may further include a bolt 216. The bold 215 may be formed at the other end of the body 210. The threaded portion 214 of the body 210 may be combined with the threaded portion 422 of the fixing hole 420 by rotating the bolt 216. The bolt 216 may include a hexagonal bole. Alternatively, the bolt 216 may include a rectangular bolt, an octagonal bolt, etc.

The support 220 may be extended from one end of the body 210. In example embodiments, the support 220 may be integrally formed with the body 210. Alternatively, the support 220 may be a part separated from the body 210.

The support 220 may be configured to support the roller housing 120 of the roller tappet 100. The support 220 may be inserted into the rotation-preventing groove 122 formed at the roller housing 120. The rotation-preventing groove 122 may be formed through the roller housing 120. Thus, the oil introduced into a first oil passageway 222 may be supplied into the roller housing 120. The support 220 may include a fixing protrusion held and supported by the rotation-preventing groove 122. The fixing protrusion may have an annular shape formed on an outer circumferential surface of the support 220. However, the fixing protrusion may have other shapes, not restricted within the above-mentioned annular shape. An oil seal 224 may be installed at one end of the support 220. The oil seal 224 may prevent the oil supplied from the main gallery 410 from flowing to the roller housing 120 along the outer circumferential surface of the body 210. Therefore, the oil seal 224 may induce the oil to the oil inlet 212 and the first oil passageway 222 to help controls of oil supplying to the roller housing 120.

The support 220 may include the first oil passageway 222. The first oil passageway 222 may be formed in the support 220 along the axial direction of the support 220. The first oil passageway 222 may be connected to the oil inlet 212 of the body 210. The first oil passageway 222 may be connected to the inside of the roller housing 120. Thus, the oil in the main gallery 410 may be supplied into the roller housing 120 through the oil inlet 212, the first oil passageway 222 and the rotation-preventing groove 122. The oil in the roller housing 120 may be supplied to the tappet roller 130 and the cam 500 through a passageway 122 formed through a lower portion of the roller housing 120. As a result, it may not be required to form an additional oil passageway for supplying the oil to the roller tappet 100 in the cylinder block 400 so that the cylinder block 400 may have a simple structure.

The body 210 may further include a second oil passageway 218. The second oil passageway 218 may be extended from the oil inlet 212 to the other end of the body 210. That is, the second oil passageway 218 may be formed in the threaded portion 214 and the bolt 216 from the oil inlet 212.

A piston cooling jet 300 may supply the oil to a piston to cool the piston. The other end of the piston cooling jet 300 may be connected to an oil duct 310 for supplying the oil the piston. When the adapter 200 may not be used, it may be required to separately provide the piston cooling jet 300. Referring to FIGS. 1 and 2, one end of the piston cooling jet 300 may be connected to the second oil passageway 218 of the adapter 200. When the adapter 200 may include a pair of the adapters 200, the piston cooling jet 300 may be combined with any one of the two adapters 200.

A bolt 340 may be installed at a remaining adapter 200. The bolt 340 may fix a supporting plate 330 connected to the piston cooling jet 300. A threaded portion may be formed at an entrance of the second oil passageway 218 of the adapter 200. The bolt 340 may be threadedly combined with the threaded portion. Further, the supporting plate 330 may include a first fixing hole 331 and a second fixing hole 333. The first fixing hole 331 may be formed at one end of the supporting plate 330. The second fixing hole 333 may be formed at the other end of the supporting plate 330.

The piston cooling jet 300 may be inserted into the first fixing hole 331. The piston cooling jet 300 may then be fixed to the second oil passageway 218. The bolt 340 may be inserted into the second fixing hole 333. The bolt 340 may then be combined with the second oil passageway 218 so that the supporting plate 330 may be combined with the adapter 200. That is, the piston cooling jet 300 and the adapter 200 may be reciprocally combined with each other. Thus, the connection between the piston cooling jet 300 and the second oil passageway 218 and the fixture between the piston cooling jet 300 and the adapter 200 may have a simple structure. An oil seal 305 may be installed at end of the piston cooling jet 300 to prevent a leakage of the oil. When the engine may be driven at a high RPM, the oil supplied through the oil inlet 212 may be transferred to the piston. In contrast, when the engine may be driven at a low RPM, the oil supplied through the oil inlet 212 may be transferred to only the roller housing 120. The oil having a high pressure may be injected from an oil pump interacted with the engine driven at the high RPM. Thus, the oil may be supplied to only the piston using the oil pressure under the above-mentioned specific condition. For example, a spring 380 and a plunger 370 may be additionally installed in the piston cooling jet 300.

As mentioned above, the oil in the main gallery 410 may be supplied to the roller tappet 100 through the first oil passageway 222 and the piston cooling jet 300 through the second oil passageway 218.

According to example embodiments, the adapter for supporting the roller tappet may include the oil passageway connected to the main gallery of the cylinder block. Thus, the oil may be supplied from the main gallery to the roller tappet through the oil passageway. As a result, it may not be required to form an additional oil passageway, which may supply the oil to the roller tappet, in the cylinder block. Further, because the piston cooling jet may be assembled with the adapter, a structure of the cylinder block for assembling the piston cooling jet may be reduced. As a result, the adapter may have the function for preventing the rotation of the roller tappet and the function for supplying the oil so that machining the cylinder block may be reduced.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An adapter for a roller tappet of an engine, the adapter comprising:

a body combined with a cylinder block of the engine, the body including an oil inlet connected to a main gallery of the cylinder block to receive an oil from the main gallery;

a support extended from one end of the body to support the roller tappet, the support including a first oil passageway connected to the oil inlet; and a piston cooling jet combined with the body, wherein the body further includes a second oil passageway extended from the oil inlet toward the other end of the body, the piston cooling jet is connected to the second oil passageway, the first oil passageway is formed through the body and the support to supply the oil introduced into the oil inlet to the roller tappet, and the body, the support, and the piston cooling jet are together insertable into or removable from the cylinder block.

2. The adapter of claim 1, wherein the body further comprises a threaded portion threadedly combined with the cylinder block.

3. The adapter of claim 2, wherein the body further comprises a bolt for threadedly combining the threaded portion with the cylinder block.

4. A roller tappet assembly of an engine, the roller tappet assembly comprising:

a roller housing configured to support a tappet rod movably arranged in a cylinder block of the engine along a vertical direction;

a tappet roller rotatably connected to one end of the roller housing, the tappet roller rotatably making contact with a cam to allow a linear reciprocal motion of the tappet rod;

an adapter combined with the cylinder block to support the roller housing, the adapter including an oil passageway for supplying an oil in a main gallery of the cylinder block into the roller housing; and a piston cooling jet combined with the adapter and connected to the oil passageway, wherein the adapter and the piston cooling jet are together insertable into or removable from the cylinder block.

5. The roller tappet assembly of claim 4, wherein the roller housing comprises a rotation-preventing groove configured to receive the adapter.

6. The roller tappet assembly of claim 4, wherein the adapter comprises a threaded portion, and the cylinder block comprises a thread portion combined with the threaded portion of the adapter.

7. The roller tappet assembly of claim 4, wherein the cylinder block comprises a fixing hole formed through the cylinder block and connected to an inner portion of the cylinder block where the roller housing is installed, the adapter is inserted into the fixing hole, and the fixing hole has a threaded portion combined with a threaded portion formed on an outer surface of the adapter.

8. The roller tappet assembly of claim 4, wherein the rotation-preventing groove is formed through the roller housing, the oil passageway is formed in the adapter and connected to the main gallery when installing the adapter, and the oil in the main gallery is supplied to the roller housing through the oil passageway and the rotation-preventing groove when installing the adapter.

* * * * *